US009634389B2

(12) United States Patent
Tseng et al.

(10) Patent No.: US 9,634,389 B2
(45) Date of Patent: Apr. 25, 2017

(54) MULTIPATH SWITCHING SYSTEM HAVING ADJUSTABLE PHASE SHIFT ARRAY

(71) Applicant: INDUSTRIAL TECHNOLOGY RESEARCH INSTITUTE, Hsinchu (TW)

(72) Inventors: Ming-Chien Tseng, Zhubei (TW); Ming-Hung Cheng, New Taipei (TW); Hsin-Piao Lin, Taoyuan (TW); Ching-Jen Chang, New Taipei (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 1017 days.

(21) Appl. No.: 13/871,052

(22) Filed: Apr. 26, 2013

(65) Prior Publication Data

US 2014/0139373 A1 May 22, 2014

(30) Foreign Application Priority Data

Nov. 20, 2012 (TW) ..... 101143274 A

(51) Int. Cl.
*H01Q 3/36* (2006.01)
*H01Q 3/38* (2006.01)
*H01Q 3/40* (2006.01)

(52) U.S. Cl.
CPC ..... *H01Q 3/36* (2013.01); *H01Q 3/385* (2013.01); *H01Q 3/40* (2013.01)

(58) Field of Classification Search
CPC .. H01Q 3/30; H01Q 3/36; H01Q 3/40; H01Q 3/385

(Continued)

(56) References Cited

U.S. PATENT DOCUMENTS 3,373,433 A * 3/1968 Blaisdell ..... H01Q 9/27 343/850
4,245,223 A * 1/1981 Evans ..... H01Q 25/007 343/778

(Continued)

FOREIGN PATENT DOCUMENTS

CN 1452270 A 10/2003
CN 200950586 Y 9/2007

(Continued)

OTHER PUBLICATIONS

Cheston et al. Radar Handbook—Chapter 7 Phased Array Radar Antennas, pp. 7.1-7.36.*

(Continued)

*Primary Examiner* — Gregory C Issing
(74) *Attorney, Agent, or Firm* — McClure, Qualey & Rodack, LLP

(57) ABSTRACT

A multipath switching system comprising of an adjustable phase shift array includes, an adjustable phase shift array module and a control module. The adjustable phase shift array module receives a radio-frequency (RF) signal, and includes at least one RF switch, at least one coupler and at least one phase shifter. The at least one RF switch, the at least one coupler and the at least one phase shifter form a number of transmission paths. The transmission paths respectively produce the processed transmission RF signals corresponding to different phase shifts to an antenna array. The control module controls the at least one RF switch and the at least one phase shifter of the adjustable phase shift array module, so that the antenna array radiates a wireless signal whose direction is corresponding to a predetermined angle in space polar coordinates.

15 Claims, 14 Drawing Sheets

(58) Field of Classification Search
USPC ..... 342/374, 373
See application file for complete search history.

(56) References Cited

U.S. PATENT DOCUMENTS

| | | | | |
|---|---|---|---|---|
| 4,489,324 | A * | 12/1984 | Blume | H01Q 3/38 342/372 |
| 4,725,844 | A * | 2/1988 | Goodwin | H01Q 3/2676 342/374 |
| 4,837,580 | A * | 6/1989 | Frazita | G01S 1/024 342/372 |
| 5,257,031 | A * | 10/1993 | Scarpetta | H01Q 3/26 342/374 |
| 5,355,139 | A * | 10/1994 | Hirata | H01Q 1/281 342/371 |
| 5,434,575 | A | 7/1995 | Jelinek et al. | |
| 5,606,283 | A | 2/1997 | Allen et al. | |
| 5,861,840 | A | 1/1999 | Tarran et al. | |
| 5,943,011 | A | 8/1999 | Acoraci et al. | |
| 6,710,742 | B1 * | 3/2004 | Meredith | H01Q 3/28 342/372 |
| 6,816,116 | B2 | 11/2004 | Chen | |
| 7,015,773 | B2 | 3/2006 | Chiang et al. | |
| 7,773,956 | B2 | 8/2010 | Fukamachi et al. | |
| 8,260,360 | B2 | 9/2012 | Rofougaran et al. | |
| 2009/0270051 | A1 | 10/2009 | Choi et al. | |

FOREIGN PATENT DOCUMENTS

| | | |
|---|---|---|
| EP | 0639035 A1 | 2/1995 |
| TW | 200947796 | 11/2009 |

OTHER PUBLICATIONS

Haring, J. "Directional Pattern Analysis of a Linear Phased Array". Advances in Electrical and Electronic Engineering 2008 vol. 7. pp. 74-77.*

TW Office Action dated May 26, 2015 in corresponding Taiwan application (No. 101143274).

English Abstract translation of TW200947796 (Published Nov. 16, 2009).

Farzaneh, et al.: "Microwave Sampling Beamformer—Prototype Verification and Switch Design"; IEEE Transactions on Microwave Theory and Techniques, vol. 57, No. 1, Jan. 2009.

Abdolee, et al.: "Digital Beam-forming Implementation for Downlink Smart Antenna System"; 978-1-4244-4480-9/09/ © 2009 IEEE.

Ibrahim, et al.: "Switched Beam Antenna using Omnidirectional Antenna Array"; Asia-Pacific Conference on Applied Electromagnetics Proceedings; 1-4244-1435-0/07 © 2007 IEEE.

Muhammad Mahfuzul Alam: "Microstrip Antenna Array with Four Port Butler Matrix for Switched Beam Base Station Application"; Proceedings of 20091t h InternationalConference on ComputerandInformationTechnology (ICCIT 2009) Dec. 21-23, 2009, Dhaka, Bangladesh.

Ahmadi-Shokouh, et al.: "Switch Loss and Antenna Directivity Effects on MIMO Antenna Selection"; CCECE/CCGEI May 5-7, 2008 Niagara Falls. Canada 978-1-4244-1643-1/08 © 2008 IEEE.

Gotsis, et al.: "Improved Butler Matrix Configuration for Smart Beamforming Operations"; Apr. 12-16, 2010.

SIPO Office Action dated Jul. 6, 2016 in CN application (No. 201210526061.2).

* cited by examiner

| control bit / candidate phase difference | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|
| -45 | 0 | 1 | 1 | 0 | 0 | 1 | 1 | 1 | 1 | 0 | 1 | 1 | 0 | 1 | 1 | 1 | 0 | 0 | 1 |
| 45 | 1 | 0 | 0 | 1 | 1 | 1 | 0 | 0 | 1 | 1 | 0 | 0 | 1 | 0 | 0 | 1 | 0 | 0 | 1 |
| -135 | 0 | 1 | 1 | 1 | 1 | 1 | 0 | 0 | 1 | 1 | 0 | 0 | 1 | 0 | 0 | 1 | 0 | 0 | 1 |
| 135 | 1 | 0 | 0 | 0 | 0 | 1 | 1 | 1 | 1 | 0 | 1 | 1 | 0 | 1 | 1 | 1 | 0 | 0 | 1 |
| -22.5 | 0 | 1 | 1 | 0 | 0 | 0 | 1 | 1 | 1 | 0 | 1 | 1 | 0 | 1 | 1 | 0 | 0 | 1 | 1 |
| 22.5 | 1 | 0 | 0 | 1 | 1 | 1 | 0 | 0 | 0 | 1 | 0 | 0 | 1 | 0 | 0 | 1 | 1 | 0 | 0 |
| -67.5 | 0 | 1 | 1 | 0 | 1 | 1 | 1 | 1 | 1 | 0 | 1 | 1 | 0 | 1 | 1 | 1 | 1 | 0 | 0 |
| 67.5 | 1 | 0 | 0 | 1 | 1 | 1 | 0 | 1 | 1 | 1 | 0 | 0 | 1 | 0 | 0 | 0 | 0 | 1 | 1 |
| -112.5 | 0 | 1 | 1 | 1 | 1 | 1 | 0 | 1 | 1 | 1 | 0 | 0 | 1 | 0 | 0 | 0 | 0 | 1 | 1 |
| 112.5 | 1 | 0 | 0 | 0 | 1 | 1 | 1 | 1 | 1 | 0 | 1 | 1 | 0 | 1 | 1 | 1 | 1 | 0 | 0 |
| -157.5 | 0 | 1 | 1 | 1 | 1 | 1 | 0 | 0 | 0 | 1 | 0 | 0 | 1 | 0 | 0 | 1 | 1 | 0 | 0 |
| 157.5 | 1 | 0 | 0 | 0 | 0 | 0 | 1 | 1 | 1 | 0 | 1 | 1 | 0 | 1 | 1 | 0 | 0 | 1 | 1 |

FIG. 4

| control bit / candidate phase difference | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|
| -45 | 0 | | | 0 | 0 | 1 | 1 | 1 | 1 | 0 | | | | | | 1 | 0 | 0 | 1 |
| 45 | 1 | | | 1 | 1 | 1 | 0 | 0 | 1 | 1 | | | | | | 1 | 0 | 0 | 1 |
| -135 | 0 | | | 1 | 1 | 1 | 0 | 0 | 1 | 1 | | | | | | 1 | 0 | 0 | 1 |
| 135 | 1 | | | 0 | 0 | 1 | 1 | 1 | 1 | 0 | | | | | | 1 | 0 | 0 | 1 |
| -22.5 | 0 | | | 0 | 0 | 0 | 1 | 1 | 1 | 0 | | | | | | 0 | 0 | 1 | 1 |
| 22.5 | 1 | | | 1 | 1 | 1 | 0 | 0 | 0 | 1 | | | | | | 1 | 1 | 0 | 0 |
| -67.5 | 0 | | | 0 | 1 | 1 | 1 | 1 | 1 | 0 | | | | | | 1 | 1 | 0 | 0 |
| 67.5 | 1 | | | 1 | 1 | 1 | 0 | 1 | 1 | 1 | | | | | | 0 | 0 | 1 | 1 |
| -112.5 | 0 | | | 1 | 1 | 1 | 0 | 1 | 1 | 1 | | | | | | 0 | 0 | 1 | 1 |
| 112.5 | 1 | | | 0 | 1 | 1 | 1 | 1 | 1 | 0 | | | | | | 1 | 1 | 0 | 0 |
| -157.5 | 0 | | | 1 | 1 | 1 | 0 | 0 | 0 | 1 | | | | | | 1 | 1 | 0 | 0 |
| 157.5 | 1 | | | 0 | 0 | 0 | 1 | 1 | 1 | 0 | | | | | | 0 | 0 | 1 | 1 |

FIG. 6

| control bit / candidate phase difference | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|
| -45 | 0 | | | 01 | | | 11 | | | 0 | | | | | | | 00 | | |
| 45 | 1 | | | 11 | | | 01 | | | 1 | | | | | | | 00 | | |
| -135 | 0 | | | 11 | | | 01 | | | 1 | | | | | | | 00 | | |
| 135 | 1 | | | 01 | | | 11 | | | 0 | | | | | | | 00 | | |
| -22.5 | 0 | | | 00 | | | 11 | | | 0 | | | | | | | 01 | | |
| 22.5 | 1 | | | 11 | | | 00 | | | 1 | | | | | | | 10 | | |
| -67.5 | 0 | | | 10 | | | 11 | | | 0 | | | | | | | 10 | | |
| 67.5 | 1 | | | 11 | | | 10 | | | 1 | | | | | | | 01 | | |
| -112.5 | 0 | | | 11 | | | 10 | | | 1 | | | | | | | 01 | | |
| 112.5 | 1 | | | 10 | | | 11 | | | 0 | | | | | | | 10 | | |
| -157.5 | 0 | | | 11 | | | 00 | | | 1 | | | | | | | 10 | | |
| 157.5 | 1 | | | 00 | | | 11 | | | 0 | | | | | | | 01 | | |

FIG. 7

MULTIPATH SWITCHING SYSTEM HAVING ADJUSTABLE PHASE SHIFT ARRAY

This application claims the benefit of Taiwan application Serial No. 101143274, filed Nov. 20, 2012, the disclosure of which is incorporated by reference herein in its entirety.

TECHNICAL FIELD

The disclosed embodiments relate to a multipath switching system having an adjustable phase shift array.

BACKGROUND

With rapid developments in wireless communication systems, wireless communication is undoubtedly an indispensible part of the daily life. As various communication theories and signal processing chips continue to progress, the signal processing techniques in back-end of mobile wireless communication for transceivers have also be reached maturity. However, the front-end theories and techniques for transceivers were made limited progress in radio-frequency (RF) wireless communication system. The limits of communication materials and physical properties are resulted in setbacks for development such as costly and complicated systems associated with the RF front end, in a way that signals can only be processed or computed by a baseband circuit instead of being readily processed at an RF front end. Therefore, there is a need for a solution for overcoming the above setbacks or changing system architecture for realizing signal processing at an RF front end.

SUMMARY

According to one embodiment, a multipath switching system comprising of an adjustable phase shift array is provided. The multipath switching system comprises an adjustable phase shift array module and a control module. The phase shift array receives a radio-frequency (RF) signal, and comprises at least one RF switch, at least one coupler and at least one phase shifter. The at least one RF switch, the at least one coupler and the at least one phase shifter form a number of transmission paths. The transmission paths respectively receive RF signals, and respectively output a number of processed RF signals corresponding to different phase shifts to an antenna array. The control module controls the at least one RF switch and the at least one phase shifter of the adjustable phase shift array module, so that the antenna array radiates a wireless signal whose direction is corresponding to the predetermined angle in space polar coordinates.

BRIEF DESCRIPTION OF THE DRAWINGS

FIG. 4 is a table listing control digital values of RF switches and phase shifters corresponding to a number of candidate phase differences.

FIG. 6 shows simplified results of the control digital bits of RF switches and phase shifter corresponding to the candidate phase differences in FIG. 4.

FIG. 7 shows further simplified results of the control digital bits of RF switches and phase shifter corresponding to the candidate phase differences in FIG. 6.

Figure 1:
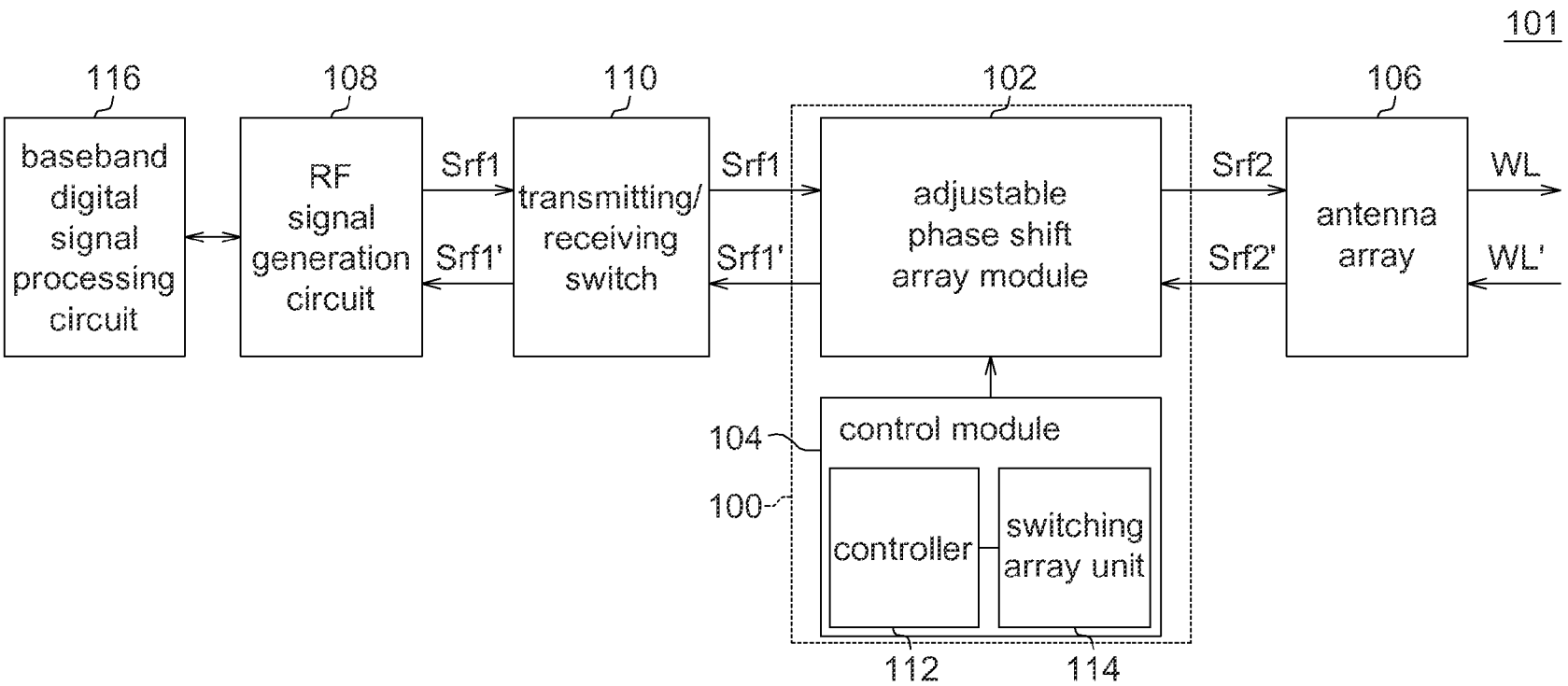
FIG. 1 is a block diagram of a multipath switching system having an adjustable phase shift array according to one embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

FIG. 1 shows a block diagram of a multipath switching system having an adjustable phase shift array according to one embodiment. A multipath switching system 100 comprises an adjustable phase shift array module 102 and a control module 104. The adjustable phase shift array module 102 receives a radio-frequency (RF) signal Sfr1, and comprises at least one RF switch, at least one coupler and at least one phase shifter. The at least one RF switch, at least one coupler and at least one phase shifter form a number of transmission paths. The transmission paths respectively receive the RF signal Srf1, and respectively output a number of processed RF signals Srf2 corresponding to different phases to an antenna array 106.

The control module 104 controls the at least one RF switch and the at least one phase shifter of the adjustable phase shift array module 102, so that the antenna array 106 outputs a wireless signal WL corresponding to a predetermined angle in space polar coordinates.

For example, the multipath switching system 100 is used in a communication system 101. The RF signal Srf1 is generated by an RF signal generation circuit 108, and is transmitted by a transmitting/receiving switch 110 switched to a transmitting mode to the adjustable phase shift array module 102. The RF signal generation circuit 108 generates the RF signal Srf1 based on a signal from a baseband digital signal processing circuit 116.

When the transmitting/receiving switch 110 is switched to a receiving mode, the communication system 101 is capable of receiving and processing a wireless signal. Upon receiving a wireless signal WL', the antenna array 106 converts the received electromagnetic wireless signal WL' to an RF signal Srf2'. The RF signal Srf2' is processed by the adjustable phase shift array module 102 to generate an RF signal Srf1'. The RF signal Srf1' is transmitted to the RF signal generation circuit 108 and the baseband digital signal processing circuit 116 via the transmitting/receiving switch 110 for subsequent baseband signal processing.

For example, the control module 104 comprises a controller 112 and a switching array unit 114. The switching array unit 114 stores control information of the at least one RF switch and the at least one phase shifter corresponding to a number of candidate phase differences. The controller 112 controls the adjustable phase shift array module 102 with reference to information stored in the switching array unit 114.

Further, the adjustable phase shift array module 102 may comprise a number of RF switches, a number of couplers and a number of phase shifters. The antenna array 106 comprises a number of antennas. The control module 104 selects one from a number of candidate phase differences, and controls the RF switches and the phase shifters according to the selected candidate phase difference. Accordingly, the phase difference for every two of the antennas have the selected candidate phase difference, so that the antenna array 106 outputs a wireless signal corresponding to a predetermined angle in space polar coordinates.

Figure 2:
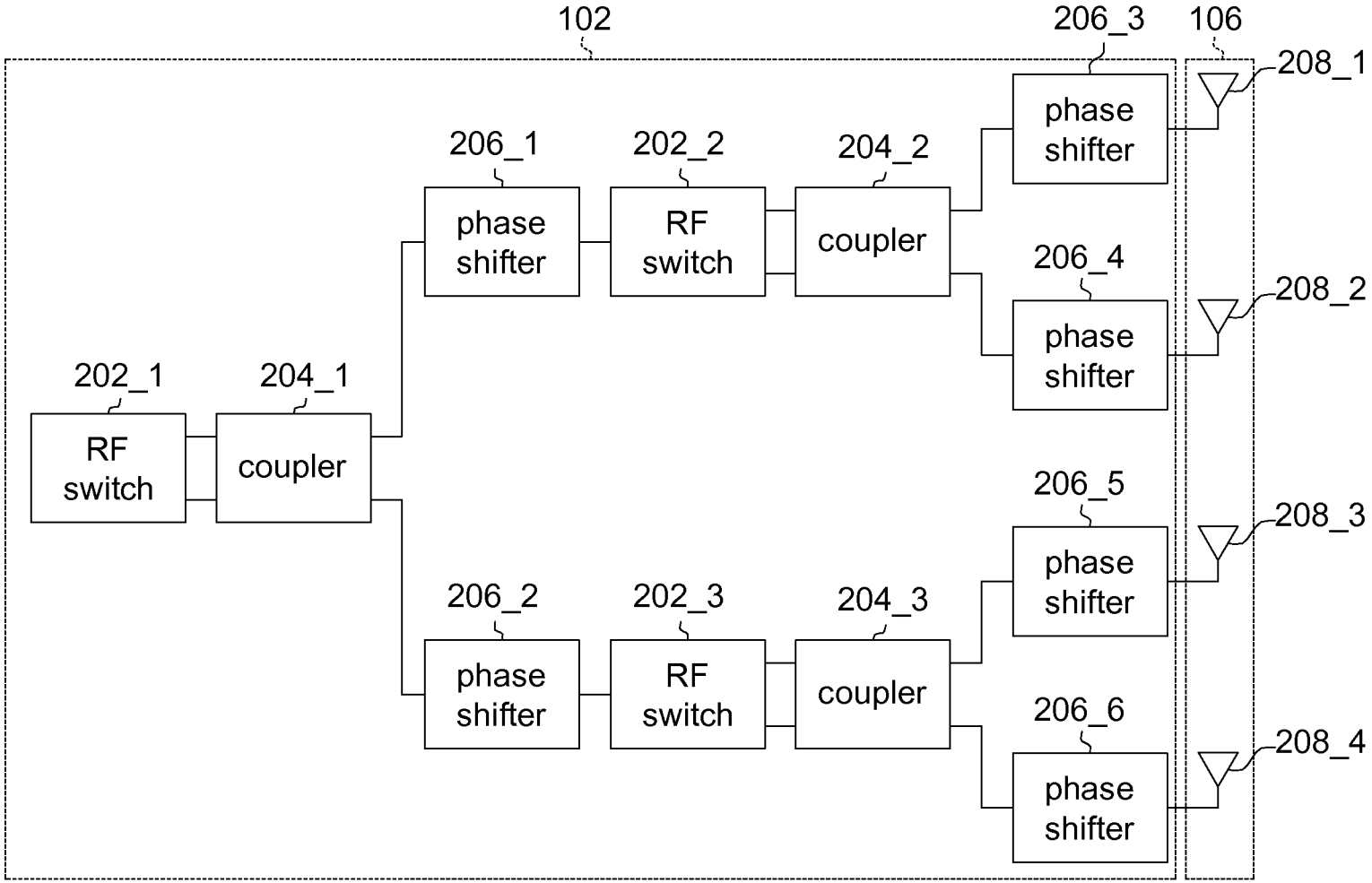
FIG. 2 is a block diagram of an adjustable phase shift array module of a multipath switching system according to one embodiment.

FIG. 2 shows a block diagram of the adjustable phase shift array module 102 in FIG. 1. The adjustable phase shift array module 102 comprises three RF switches 202_1 to 202_3, three couplers 204_1 to 204_3 and six phase shifters 206_1 to 206_6. The antenna array 106 comprises four antennas 208_1 to 208_4. Inputs of the coupler 204_1 are connected in series to the RF switch 202_1. The phase shifters 206_1 and 206_2 are respectively connected to two outputs of the coupler 204_1. The RF switch 202_2 is connected to the phase shifter 206_1 and inputs of the coupler 204_2. The RF switch 202_3 is connected to the phase shifter 206_2 and inputs of the coupler 204_3. The phase shifters 206_3 and 206_4 are respectively connected to two outputs of the coupler 204_2. The phase shifters 206_5 and 206_6 are respectively connected to two outputs of the coupler 204_3.

Figure 3:
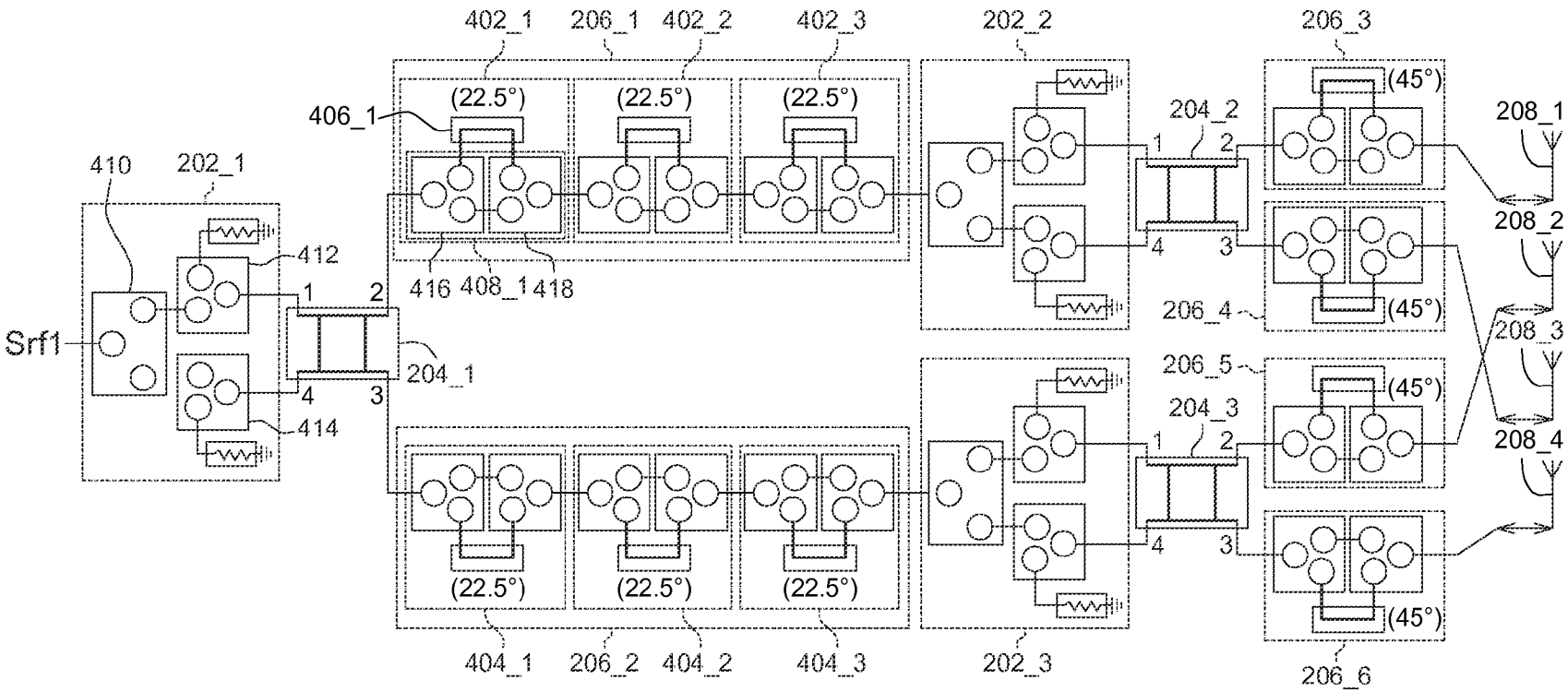
FIG. 3 is a detailed schematic diagram of the adjustable phase shift array module according to one embodiment.

FIG. 3 shows a detailed schematic diagram of the adjustable phase shift array module 102 in FIG. 2. Each of the phase shifters may selectively provide a number of different phase shifts. For example, the phase shifters 206_1 and 206_2 may selectively provide four different phase shifts, e.g., 0°, −22.5°, −45° and −67.5°. The phase shifters 206_3 to 206_6 may selectively provide two different phase shifts, e.g., 0° and −45°, respectively. Further, the phase shifter 206_1 has three phase shift units 402_1 to 402_3 connected in series, and the phase shifter 206_2 has three phase shift units 404_1 to 404_3 connected in series. The phase shifters 206_3 to 206_6 respectively have one phase shift unit. Each of the phase shift units has a microstrip line and a switch element, e.g., the phase shift unit 402_1 has a microstrip line 406_1 and a switch element 408_1. Each of the switch elements has two switches each having three end points, e.g., the switch element 408_1 has switches 416 and 418. By utilizing microstrip line having different geometric structures, signal passing through the microstrip lines are allowed to produce different phase delays. In this embodiment, the phase sifters 206_1 and 206_2 as a serially connected type phase shifter are taken as an example, and this disclosure are not limited thereto.

Each RF switch may be consisted of three switches. For example, the RF switch 202_1 comprises switches 410, 412 and 412, each of which having three end points. An input of the switch 410 receives the RF signal Srf1 or outputs the RF signal Srf1'. Inputs of the switches 412 and 414 are respectively connected to two outputs of the switch 410. Outputs of the switches 412 and 414 are connected to two inputs 1 and 4 of the coupler 204_1.

The couplers 204_1, 204_2 and 204_3 have an input 1 and an input 4, and an output 2 and an output 3, respectively. When the signal is inputted at the input 1, the signal phase difference between the output 2 and the input 1 is −90 degrees, and the signal phase difference between the output 3 and the input 1 is −180 degrees. When a signal is inputted at the input 4, the signal phase difference between the output 2 and the input 4 is −180 degrees, and the signal phase difference between the output 3 and the input 4 is −90 degrees.

FIG. 4 shows a table listing control digital values of RF switches and phase shifters corresponding to a number of candidate phase differences according to one embodiment. Assume that the candidate phase differences include −45°, 45°, −135°, 135°, −22.5°, 22.5°, −67.5°, 67.5°, −112.5°, 112.5°, −157.5°, and 157.5°. Each of the candidate phase differences corresponds to 19 bits of control digital value, for example, bit 1 to bit 19 of control digital value as shown in the first row of the table in FIG. 4. The phase shifts 157.5°, 135°, 112.5°, 67.5°, 45°, 22.5°, −22.5°, −45°, −67.5°, −112.5°, −135°, and −157.5° are used so that the antenna array 106 correspondingly radiates wireless signals which the angles of space polar coordinates are 28.955°, 41.409°, 51.317°, 67.975°, 75.52°, 82.819°, 97.180°, 104.47°, 112.024°, 128.682°, 138.59° and 151.044°.

Figure 5:
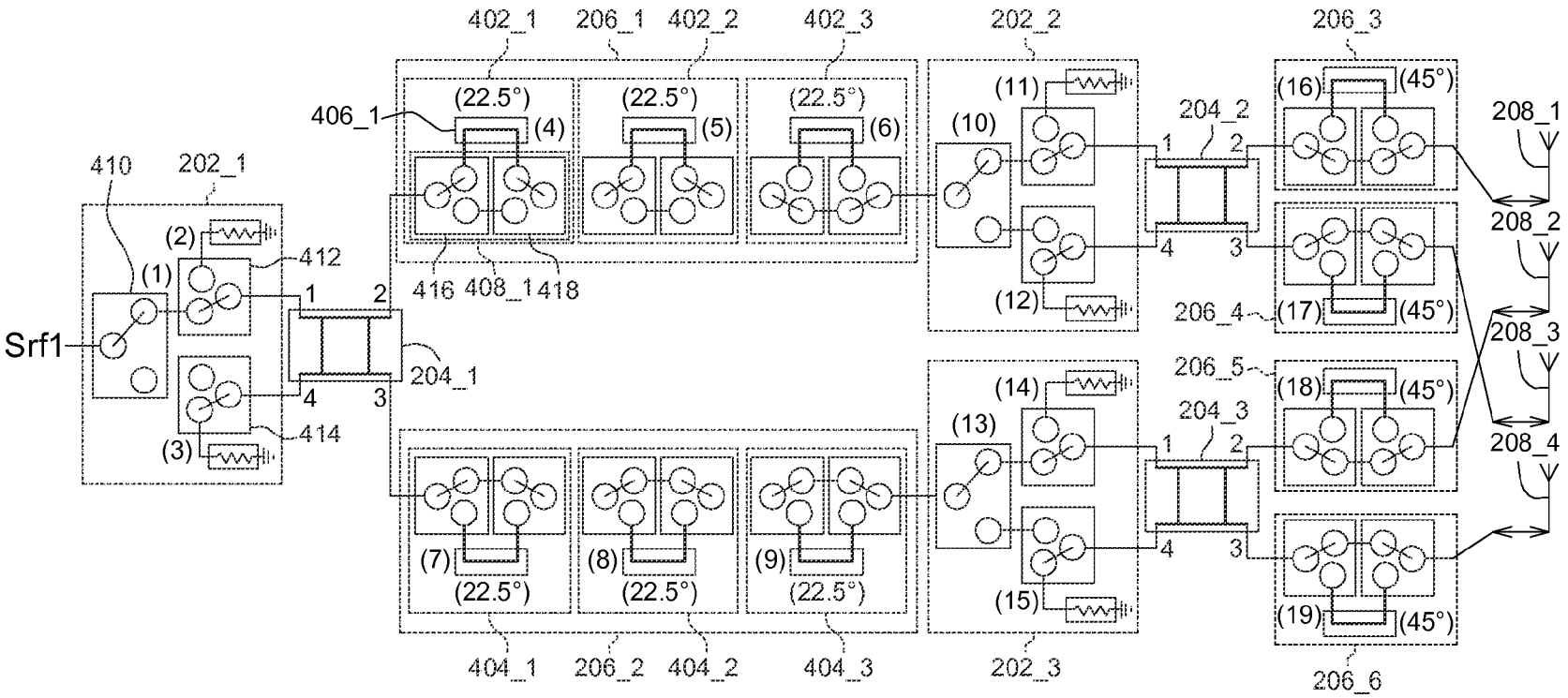
FIG. 5 is a schematic diagram and a corresponding status of an adjustable phase shift array module when a candidate phase difference is −45°.

FIG. 5 shows a schematic diagram and a corresponding status of the adjustable phase shift array module 102 when the candidate phase difference is −45°. In FIG. 5, numbers in parentheses represents the control bits for corresponding switches. For example, the control bits 1, 2 and 3 corresponding to the −45° phase shift are respectively for controlling the switches 410, 412 and 414 of the RF switch 202_1. The switch elements of the phase shift units 402_1 to 402_3 of the phase shifter 206_1 are respectively controlled by the control bits 4, 5 and 6, e.g., the control bit 4 concurrently controls the two switches 416 and 418 of the switch element 408_1. In this embodiment, the phase shifter 206_2 and the RF switches 206_5 and 206_6, an upper path of the switches is turned on when the digital value of the control bit is 1, and a lower path of the switches is turned on when the digital value of the control bit is 0. In other phase shifters and RF switches, the upper path of the switches is turned on when the digital value of the control bit is 0, and the lower path of the switches is turned on when the digital value of the control bit is 1.

As seen from FIG. 5, the RF signal Srf1 is transmitted to the input 1 of the coupler 204_1 via the RF switch 202_1, and the outputs 2 and 3 of the coupler 204_1 respectively output RF signals, which respectively have phase shifts of −90° and −180° from the RF signal Srf1 at the input of the RF switch 202_1. The RF signals pass through two microstrip lines each corresponding to a phase shift of 22.5° (and thus adding up to 45°), such that the output phase shift (i.e., the phase shift from the RF signal Srf1 at the input of the RF switch 202_1) is −90+(−45) degrees. After the RF signal which has −90+(−45) degrees phase shift is switched by 202_2 to the input end 1 of the coupler 204_2, the outputs 2 and 3 of the coupler 204_2 respectively output RF signals which have −90+(−45)−90 degrees and −90+(−45)−180 degrees phase shifts. The RF signal having the −90+(−45)−90 degree phase shift is transmitted to the antenna 208_1 after passing through the phase shifter 206_3 (currently corresponding to a 0 degree phase shift). The RF signal which has the −90+(−45)−180 degrees phase shift is transmitted to the antenna 208_3 after passing through the phase shifter 206_4 (currently corresponding to a 0 degree phase shift). Thus, the phase shifts of antennas 208_1 and 208_3 for wireless signals respectively are −90+(−45)−90=−225 degrees and −90+(−45)−180=−315 degrees.

It can be similarly deduced that, the antennas 208_2 and 208_4 respectively phase shifts of output wireless signals are −180+0−90=−270 degrees and −180+0−180=−360 degrees. Therefore, the phase shift between every two antennas (e.g., the antennas 208_2 and 208_1) is −45 degrees.

The control information of the RF switches and phase shifters can be stored in the switching array unit 114, and the controller 112 controls the adjustable phase shift array module 102 according to the information contents stored in the switching array unit 114. The control information in FIG. 4 can be further simplified.

For example, since the digital values of the control bits 10 to 15 exist in only two patterns, 011011 and 100100, it can be simplified that only one control bit is used for replacing the control bits 10 to 15. That is, 0 and 1 of the one control bit can respectively represent the above two patterns. Similarly, the control bits 1 to 3 can also be replaced by one control bit, as shown in FIG. 6. Further, as the digital values of the control bits 4 to 6 exist in only four patterns, 001, 111, 000 and 011, it can be simplified that two control bits are used for replacing the control bits 4 to 6. That is, 00, 11, 00 and 10 of the two control bits can respectively represent the above four patterns. Similarly, it can be simplified that two bits are used for representing the control bits 7 to 9 and another two bits are used for representing the control bits 16 to 19. The simplified control digital values are as shown in FIG. 7. Accordingly, each phase shift could be controlled by eight digital bits, which is in equivalence reducing a data amount of the switching array unit 114. In practice, by generating control digital values corresponding to FIG. 4 with reference to the simplified control digital values stored in the switching array unit 114, the controller 112 can control all the RF switches and the switches of all the phase shifters.

Figure 8A:
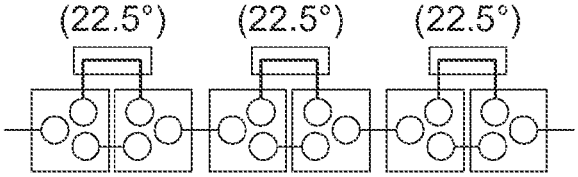
FIG. 8A depicts a serially connected type phase shifter according to one embodiment.
Figure 8B:
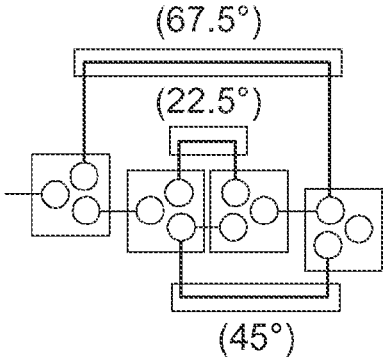
FIG. 8B depict a parallelly connected type phase shifter according to one embodiment.

In the above embodiment, the phase shifters 206_1 and 206_2 respectively are a serially connected type, in which three switch elements (six switches) are connected in series as shown in FIG. 8A, are taken as an example. The embodiment is not limited thereto. The phase shifters in the above embodiment may also be implemented by a parallelly connected type phase shifter. FIG. 8B shows a schematic diagram of an example of a parallelly connected type phase shifter, in which at least one switch is connected to two microstrip lines. Further, the phase shifters in the above embodiment may also be implemented by a serially-parallelly connected type phase shifter. The serially-parallelly connected type phase shifter is a combination of serially connected type phase shifter and parallelly connected type phase shifter, as an example shown in FIG. 8C.

Figure 8C:
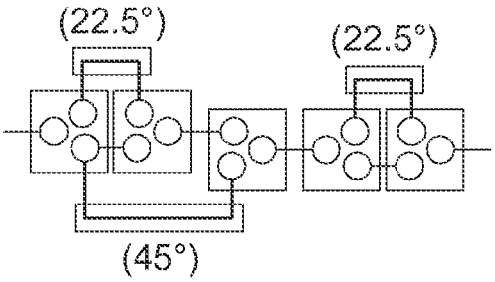
FIG. 8C depicts a serially-parallelly connected type phase shifter according to one embodiment.
Figure 9A:
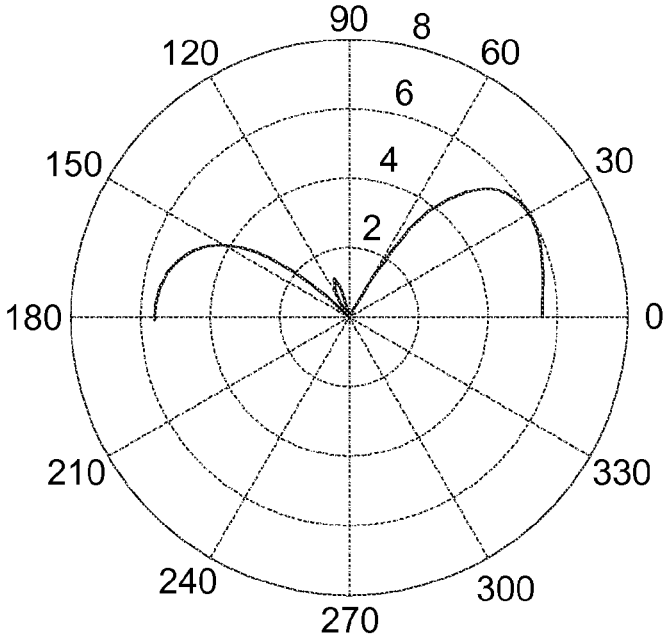
FIGS. 9A to 9L are diagrams showing locations of the main beam in the space polar coordinates in the simulated and measured result when a direction of a main beam is 29°, 41.4°, 51.3°, 68°, 75.5°, 83°, 97°, 104°, 112°, 129°, 139° and 151°, respectively.
Figure 9B:
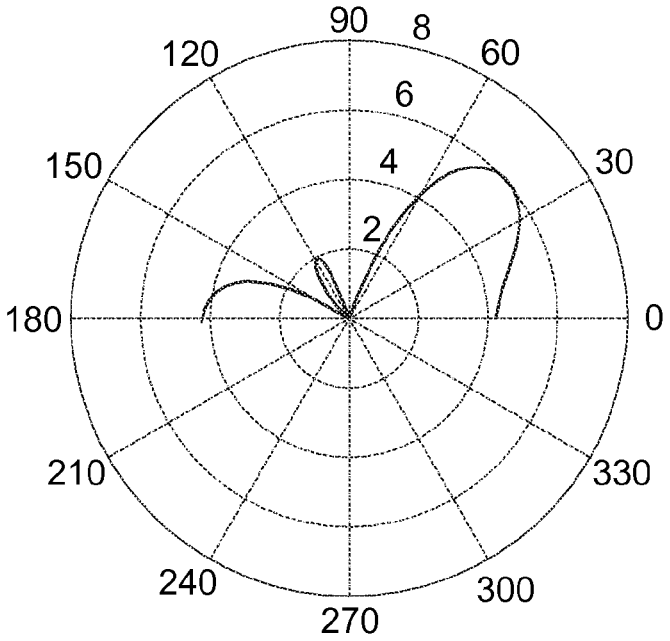
Figure 9C:
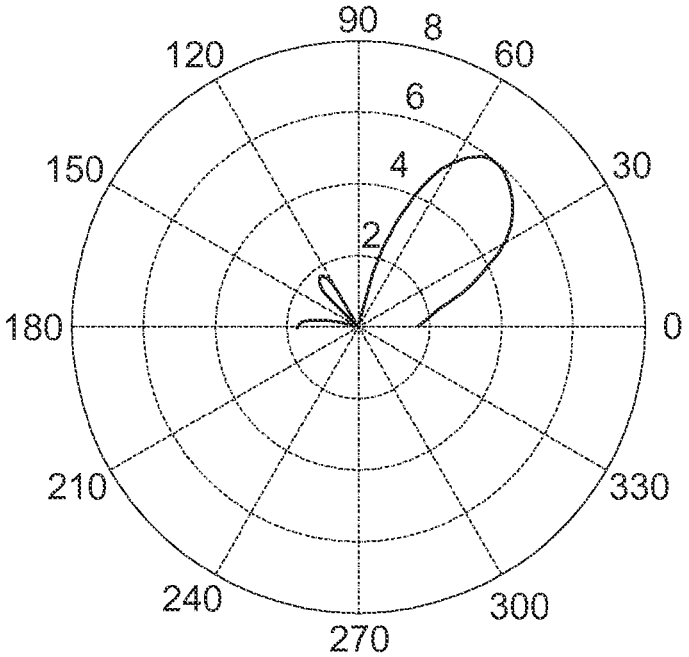
Figure 9D:
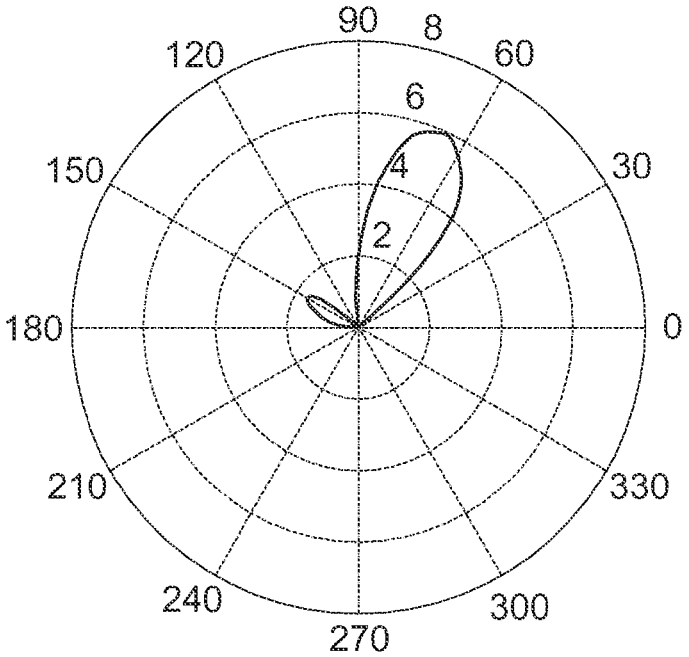
Figure 9E:
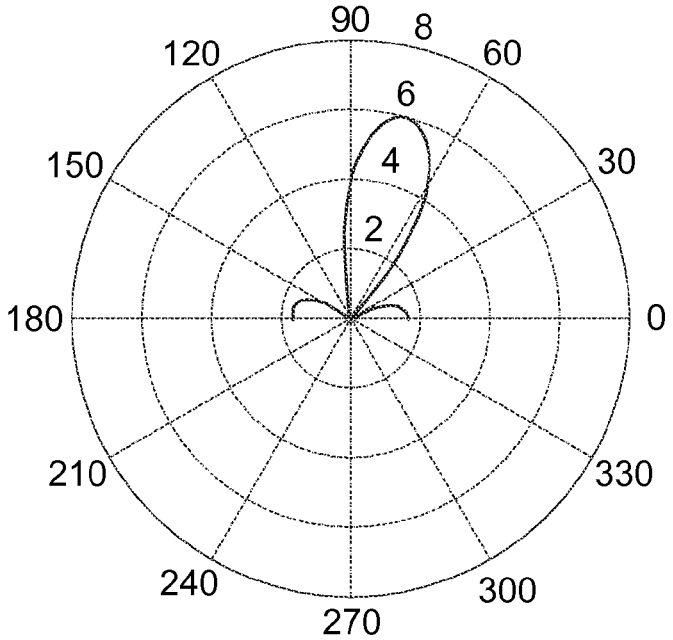
Figure 9F:
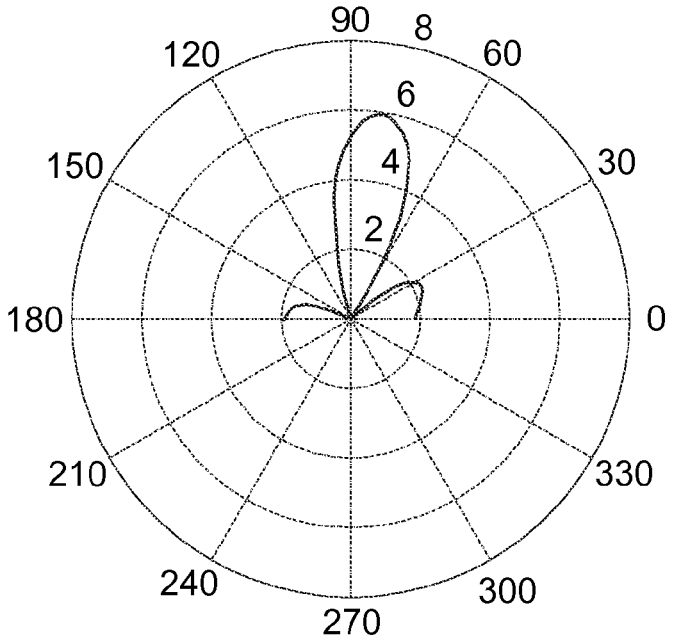
Figure 9G:
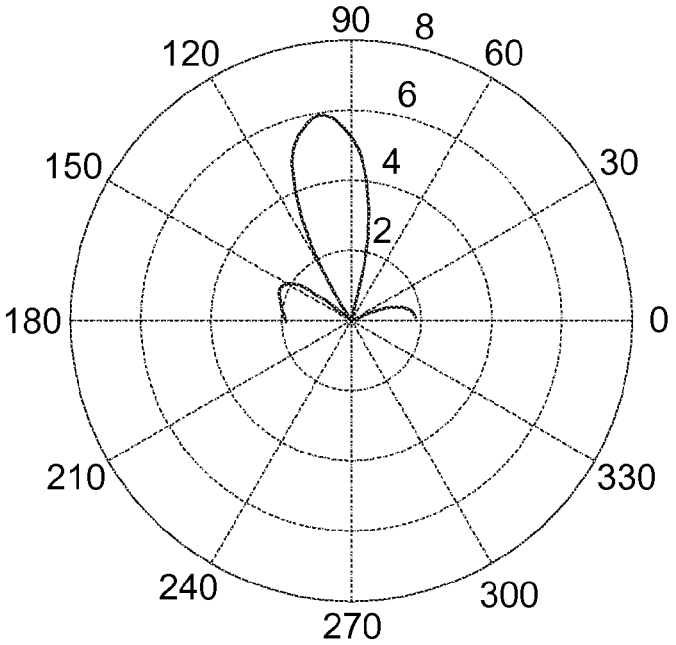
Figure 9H:
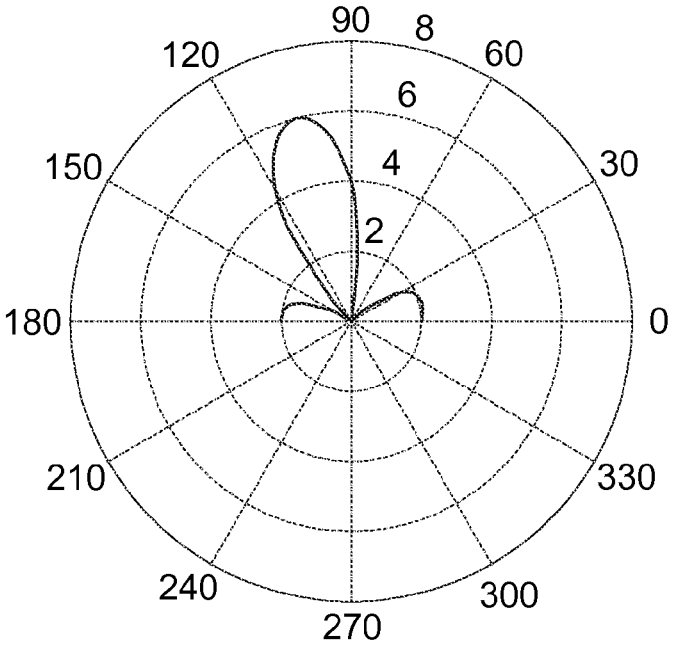
Figure 9I:
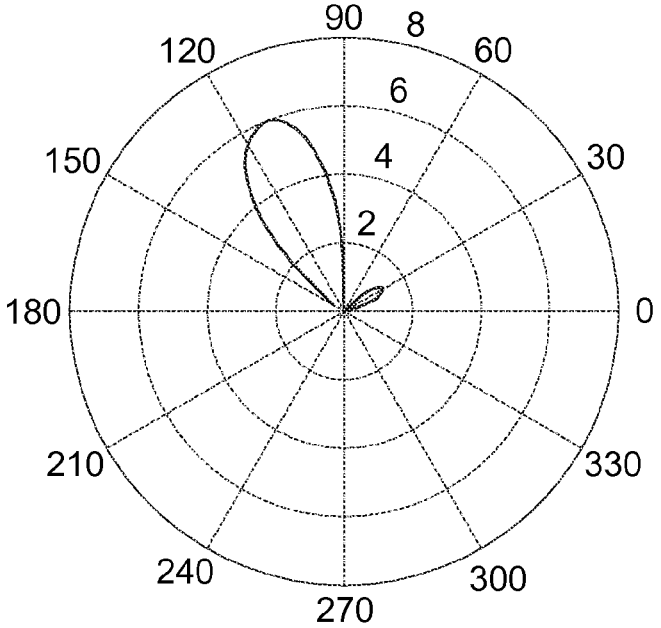
Figure 9J:
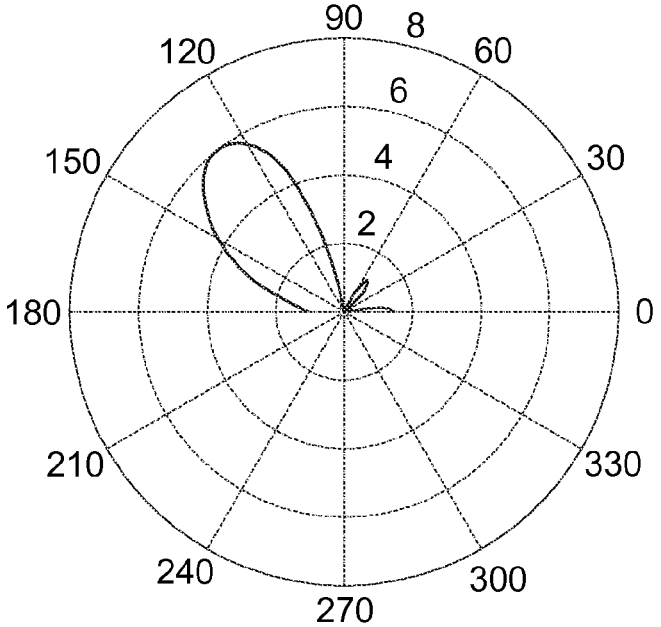
Figure 9K:
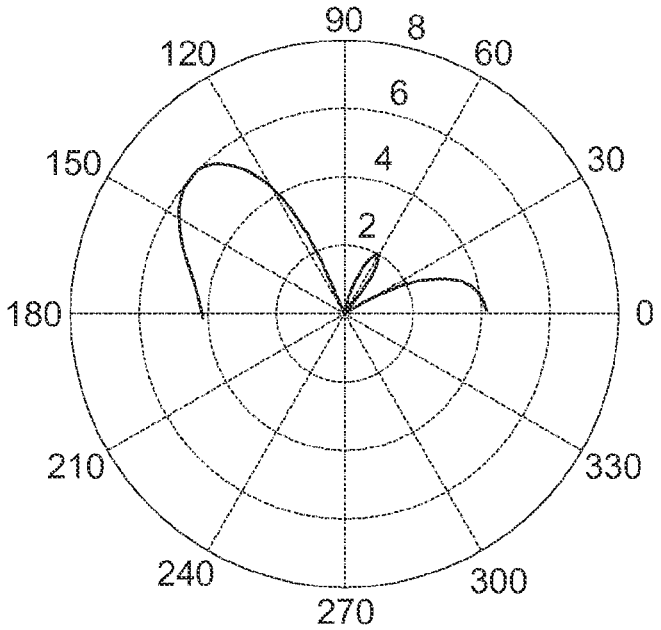
Figure 9L:
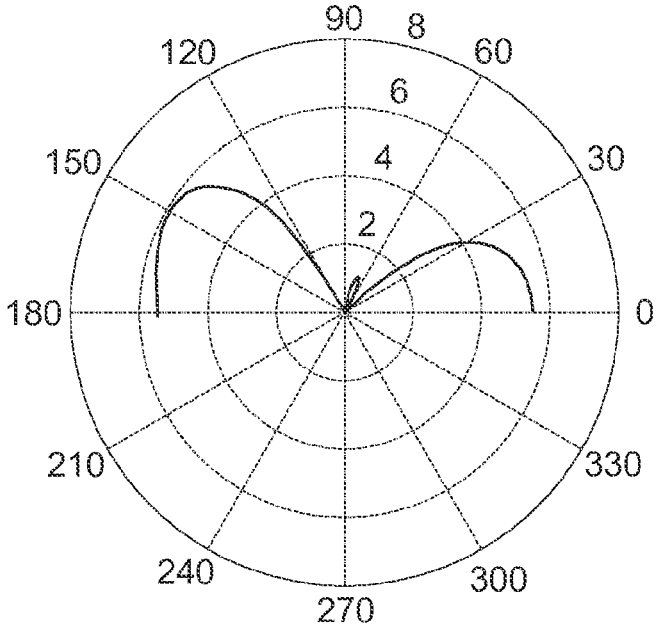

The phase shifts corresponding to the microstrip lines, the number of microstrip lines, the number of switches, and connection methods of the microstrip lines and the switches may be modified according to actual needs, and are not limited to those shown in FIGS. 8A to 8C.

The above RF switch may be a combination of high-frequency microwave switches. The high-frequency microwave switch may be a single-pole double-throw (SPDT) switch, an impedance matching switch, or a switch with a terminal resistance. The above coupler may be a branch line coupler, a ring coupler, a parallel line coupler, a microstrip line coupler or a stripline coupler. Different couplers could be applied to produce different phase shifts and sum to different spatial angles by antenna array.

The foregoing embodiment is applicable to bidirectional signal transmission. That is, although an example of an antenna transmitting wireless signals is illustrated in the foregoing embodiment, the embodiment is also suitable for situations of an antenna receiving wireless signals.

Further, in the foregoing embodiment, the 12 candidate phase differences corresponding to 12 angles in space polar coordinates of the antenna 106 are given as an example, which is not a limitation to the disclosure. The number of angles in space polar coordinates (corresponding to the number of directions of beams) may be associated with $2^n$. When n=2, $2^n=2^2=4$, and the candidate phase differences may be $\pi/4$, $-\pi/4$, $3\pi/4$ and $-3\pi/4$. At this point, there are $2^2=4$ directions which could be formed within a 180-degree range in the front of the antenna 106. When n=3, $2^n=2^3=8$, and the candidate phase differences may be $\pi/8$, $-\pi/8$, $3\pi/8$, $-3\pi/8$, $5\pi/8$, $-5\pi/8$, $7\pi/8$ and $-7\pi/8$. At this point, there are $2^2+2^3=12$ directions (corresponding to $\pi/4$, $-\pi/4$, $3\pi/4$, $-3\pi/4$, $\pi/8$, $-\pi/8$, $3\pi/8$, $-3\pi/8$, $5\pi/8$, $-5\pi/8$, $7\pi/8$ and $-7\pi/8$) which could be formed within a 180-degree range in the front of the antenna 106. When n=4, $2^n=2^4=16$, and the candidate phase differences may be $\pi/16$, $-\pi/16$, $3\pi/16$, $-3\pi/16$, $5\pi/16$, $-5\pi/16$, $7\pi/16$, $-7\pi/16$, $9\pi/16$, $-9\pi/16$, $11\pi/16$, $-11\pi/16$, $13\pi/16$, $-13\pi/16$, $15\pi/16$ and $-15\pi/16$. At this point, there are $2^2+2^3+2^4=28$ directions which could be formed within a 180-degree range in the front of the antenna 106. That is to say, the number of angles in space polar coordinates is $2^n+2^{n-1}+2^{n-2}$ . . . .

For the embodiment, 12 spatial angles of the beam in the disclosure, the arrangement of antenna array is line type which arranged by four omni-directional antennas and the distance between every two antennas is half wavelength for transmission signal. FIGS. 9A to 9L are diagrams showing locations of the main beam in the space polar coordinates in the simulated and measured result when the direction of the main beam of the linear antenna array is 29°, 41.4°, 51.3°, 68°, 75.5°, 83°, 97°, 104°, 112°, 129°, 139° and 151°, respectively.

In the multipath switching system including an adjustable phase shift array according to the embodiments, different phase shift can be produced not only by different paths, but also by the same path through controlling the states of the switches. By generating the required signal phase delay for the antennas, the antenna array is enabled to produce different spatial directions and angles for the main beam. Therefore, the multipath switching system having an adjustable phase shift array according to the embodiments, featuring a simple circuit architecture, low costs and easy controlling procedures, can be effectively integrated to an existing architecture and applied to RF front end for wireless communication without changing system architecture of base station.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A multipath switching system comprising of an adjustable phase shift array, comprising:

an adjustable phase shift array module, for receiving a radio-frequency (RF) signal, comprising at least one RF switch, at least one coupler and at least two phase shifters; the at least one RF switch, the at least one coupler and the at least two phase shifters forming at least two transmission paths, the transmission paths respectively receiving the RF signal, and respectively outputting a plurality of processed RF signals corresponding to different phase shifts to an antenna array; and a control module, for controlling the at least one RF switch and the at least two phase shifters of the adjustable phase shift array module, so that the antenna array radiates a wireless signal whose direction is corresponding to a predetermined angle in space polar coordinates, wherein as for a plurality of antennas of the antenna array, a phase shift between every two adjacent antennas is selected among a plurality of candidate phase differences selected by the control module; and the adjustable phase shift array module comprises three RF switches, three couplers and six phase shifters;

the three RF switches comprise first to third RF switches, the three couplers comprise first to third couplers, and the six phase shifters comprise first to sixth phase shifters;

the antenna array comprises four antennas;

inputs of the first coupler are connected in series to the first RF switch, the first phase shifter and the second phase shifter are respectively connected to two outputs of the first coupler, the second RF switch is connected to the first phase shifter and inputs of the second coupler, the third RF switch is connected to the second phase shifter and inputs of the third coupler, the third phase shifter and the fourth phase shifter are respectively connected to two outputs of the second coupler, and the fifth phase shifter and the sixth phase shifter are respectively connected to two outputs of the third coupler.

2. The multipath switching system according to claim 1, wherein the control module selects-one from a plurality of candidate phase differences, and controls the RF switches and the phase shifters according to the selected one of the candidate phase differences between every adjacent two of the antennas, so that the antenna array radiates the wireless signal whose direction is corresponding to the predetermined angle in space polar coordinates.

3. The multipath switching system according to claim 1, wherein the first and second phase shifters produce four different phase shifts selectively, and the third to sixth phase shifts produce two different phase shifts, respectively.

4. The multipath switching system according to claim 3, wherein the first and second phase shifter respectively comprise three phase shift units connected in series, the third to sixth phase shifters respectively comprise one phase shift unit, and each of the phase shift units comprise a microstrip line and a switch element.

5. The multipath switching system according to claim 1, wherein each of the at least one phase shifter selectively provides a plurality of different phase shifts.

6. The multipath switching system according to claim 1, wherein each of the at least one phase shifter comprises at least one microstrip line and at least one switch element.

7. The multipath switching system according to claim 1, wherein the at least one phase shifter is a parallelly connected type phase shifter.

8. The multipath switching system according to claim 1, wherein the at least one phase shifter is a serially connected type phase shifter.

9. The multipath switching system according to claim 1, wherein the at least one phase shifter is a serially-parallelly connected type phase shifter.

10. The multipath switching system according to claim 1, wherein each of the at least one coupler has a first input, a second input, a first output and a second output; when a signal is inputted at the first input, a signal phase difference between the first output and the first input is −90 degrees, and the signal phase difference between the second output and the first input is −180 degrees; and when the signal is inputted at the second input, the signal phase difference between the first output and the second input is −180 degrees, and the signal phase difference between the second output and the second input is −90 degrees.

11. The multipath switching system according to claim 1, wherein the control module comprises a controller and a switching array unit; the switching array unit stores control information of the at least one RF switch and the at least one phase shifter corresponding to a plurality of candidate phase differences; and the controller controls the adjustable phase shift array module according to information contents stored in the switching array unit.

12. The multipath switching system according to claim 11, wherein the switching array unit stores simplified control digital values of the at least one RF switch and the at least one phase shifter of the adjustable phase shift array module.

13. The multipath switching system according to claim 1, wherein the at least one RF switch is a combination of high-frequency microwave switches.

14. The multipath switching system according to claim 1, wherein the at least one RF switch is a single-pole double-throw (SDPT) switch, an impedance matching switch, or a switch with a terminal resistance.

15. The multipath switching system according to claim 1, wherein the at least one coupler is a branch line coupler, a ring coupler, a parallel line coupler, a microstrip line coupler or a stripline coupler.

* * * * *